United States Patent [19]

Kikuchi et al.

[11] 4,134,766

[45] Jan. 16, 1979

[54] DYE IMAGE FORMING PROCESS

[75] Inventors: Shoji Kikuchi, Hachioji; Hajime Wada, Tokyo; Takaya Endo, Hino; Hidetaka Deguchi, Tama; Toshiki Komaita; Wataru Ishikawa, both of Hachioji, all of Japan

[73] Assignee: Konishiroku Photo Industry Co., Ltd., Tokyo, Japan

[21] Appl. No.: 843,704

[22] Filed: Oct. 19, 1977

[30] Foreign Application Priority Data

Oct. 23, 1976 [JP] Japan ..... 51-127426

[51] Int. Cl.[2] ..... G03C 7/00; G03C 1/40

[52] U.S. Cl. ..... 96/55; 96/100 R

[58] Field of Search ..... 96/55, 100 R

[56] References Cited

U.S. PATENT DOCUMENTS

| | | | |
|---|---|---|---|
| 3,620,747 | 11/1971 | Marchant et al. | 96/100 |
| 4,009,038 | 2/1977 | Arai et al. | 96/100 |
| 4,012,258 | 3/1977 | Kojima et al. | 96/55 |
| 4,052,212 | 10/1977 | Deguchi et al. | 96/55 |

*Primary Examiner*—J. Travis Brown

*Attorney, Agent, or Firm*—Haseltine, Lake, & Waters

[57] ABSTRACT

Cyan couplers of the 2-equivalent type having the formula

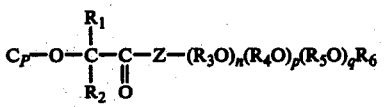

wherein $C_p$, $R_1$-$R_6$, Z, n, p and q are herein defined are described. These couplers are useful in photography, and photographic materials and developers incorporating these couplers are also described.

16 Claims, No Drawings

DYE IMAGE FORMING PROCESS

The present invention relates to a dye image forming process. More particularly, the invention is concerned with a dye image forming process wherein a novel 2-equivalent coupler is employed in photography using silver halides as photosensitive components.

In photography, a silver halide is broadly used as a photosensitive component for recording optical information because it is excellent in photographic properties such as sensitivity and gradation. When silver halide is used as a photosensitive component and intended to obtain a color image associated therewith, the silver halide is combined in general with a certain kind of a color-forming compound, and in response to the information recorded by the silver halide, the color-forming compound is reacted with a certain kind of a reactive compound to form a dye image. The color-forming compound is a so-called coupler and in general, the reactive compound to be used in combination with the coupler is a color developing agent, for example, a developing agent of the aromatic primary amine type.

In general, light-sensitive photographic materials are divided into two types, i.e. "outer type" and "inner type". The light-sensitive photographic materials of the outer type do not contain a coupler therein but are processed by use of a developer containing a diffusible coupler, while those of the inner type have a non-diffusible coupler dispersed therein. A light-sensitive photographic material of the latter type contains a yellow coupler in a blue-sensitive layer to form a yellow dye, a magenta coupler in a green-sensitive layer to form a magenta dye and a cyan coupler in a red-sensitive layer to form a cyan dye. When the light-sensitive photographic material of this type, after imagewise exposure to light, is developed in the presence of a color developing agent such as of the aromatic primary amine, the color developing agent reduces the silver halide into developed silver, while undergoing oxidation to form an active oxidation product of the color developing agent. The thus formed oxidation product in turn causes a coupling reaction with the coupler in each light-sensitive layer to form a dye therein, as a result of which the respective dye images are formed in response to the optical information recorded in each light-sensitive layer.

In this process, the reaction between the coupler and the color developing agent is caused to occur at the active position of the coupler, and in general, the active point is present on an active methine or methylene group in the coupler molecule.

A coupler having a hydrogen atom at this active position is called a 4-equivalent coupler, and a coupler having, at this active position, a so-called split-off group which can readily split off during the reaction of the coupler with the color developing agent is called a 2-equivalent coupler.

When the 4-equivalent coupler reacts with the color developing agent, it requires four equivalents of silver halide having a development nucleus per active position, whereas the 2-equivalent coupler requires only two equivalents of silver halide. As a consequence, in general, the 2-equivalent coupler provides a dye image of higher density when the amount of developed silver is the same. In case of the 2-equivalent coupler, if a group (linking group) at the joint portion of the split-off group linked to the active position is appropriately chosen it is possible to impart a development-inhibiting activity to a compound formed upon splitting-off of the split-off group. Thus, for example, a 2-equivalent coupler having a split-off group with a thio group as the linking group is called a development inhibitor releasing coupler (DIR coupler). Since, in this coupler, the development is inhibited in proportion to the quantity of the developed silver, this coupler can be used for a variety of applications. For example, the DIR coupler exhibits so-called intra-image effects such as the effects of controlling an image tone and making image particles finer in the layer into which the coupler has been incorporated and inter-image effects such as the effect of improving the color hue in other layers. In addition, by utilizing the actions of the DIR coupler to other layers, it is used for the diffusion transfer system.

Moreover, some 2-equivalent couplers, for example, those having a dye portion in the split-off group, can be used for the diffusion transfer system by utilizing the split dye for formation of a color image of diffusible dyes on an image-receiving layer. The coupler of this type is called a diffusible dye releasing coupler (DDR coupler). Furthermore, some colored 2-equivalent couplers have an masking effect of complementing a dye image. A coupler of this type is called a colored coupler.

As will be apparent from the foregoing illustration, 2-equivalent couplers are essentially excellent over 4-equivalent couplers and have a variety of applications. As a consequence, they tend to be used more and more.

Although known 2-equivalent couplers are superior to 4-equivalent couplers in various properties, they are still insufficient in some aspects. For example, their dye-forming speed is low and 2-equivalent couplers tend to impart fogs to a silver halide-containing light-sensitive layer or to stain the light-sensitive layer. Still further, they cannot be dispersed into light-sensitive layers at sufficient concentrations. Accordingly, it has been desired to improve 2-equivalent couplers in these insufficient properties.

Reference is now made more specifically in this regard. As 2-equivalent yellow couplers, there may be mentioned for example halogen-substituted type couplers as disclosed in U.S. Pat. No. 3,277,155, sulfonyloxy type couplers as disclosed in U.S. Pat. No. 3,415,682 and saccharin type couplers as disclosed in Japanese Patent Publication No. 25,933/1973. As 2-equivalent magenta couplers, there can be mentioned for example halogen-substituted type couplers as disclosed in U.S. Pat. No. 3,006,579, aryloxy-substituted type couplers as disclosed in U.S. Pat. No. 3,419,391 and N-substituted type couplers as disclosed in Japanese Laid-Open-To-Public Patent Publication No. 53,372/1975. As 2-equivalent type cyan couplers, there can be mentioned for example aryloxy-substituted type couplers as disclosed in U.S. Pat. No. 3,476,563 and N-substituted type couplers as disclosed in U.S. Pat. No. 3,458,315. All of these 2-equivalent couplers have excellent properties in comparison with hitherto known 4-equivalent couplers. However, some of them, for example such couplers as disclosed in U.S. Pat. Nos. 3,277,155, 3,730,722 and 3,006,579, tend to cause fogging, color-staining and the like in silver halide-containing light-sensitive layers, while some of them, for example such couplers as disclosed in Japanese Laid-Open-To-Public Patent Publication No. 53,372/1975 and U.S. Pat. No. 3,458,315 suffers drawbacks of inadequate speed of dye formation and incapability of being dispersed in light-sensitive layers at sufficient concentrations. Thus, all the couplers disclosed in the above-mentioned references more or less leave much to be improved. With an aim to overcoming these drawbacks have been proposed 2-equivalent couplers of the carbonylmethoxy type in Japanese Laid-Open-To-Public Patent Publication No. 117,422/1975 and Japanese Patent Application No. 94,294/1975. Admittedly the couplers of the type disclosed in these two references exhibit relatively advantageous properties over conventional 2-equivalent couplers, but they should still be improved in some respects, in particular with respect to such properties as speed of dye formation and solubility in solvents.

It is therefore a primary object of the present invention to provide a novel 2-equivalent coupler which provides excellent photographic properties, eliminating the foregoing defects involved in the use of conventional couplers.

Another object of the present invention is to provide a light-sensitive silver halide photographic material and a photographic process which employs the novel 2-equivalent coupler to form a desirable dye image.

In accordance with the present invention, for example, there is provided a dye image forming process in which an imagewise exposed light-sensitive silver halide photographic material is developed with an aromatic primary amine developing agent in the presence of a coupler of the following general formula (I):

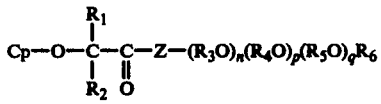

(I)

wherein Cp stands for a monovalent residue obtained by eliminating one hydrogen atom at the active position of a cyan coupler; $R_1$ and $R_2$ each stand for hydrogen, halogen or a monovalent group; $R_3$, $R_4$ and $R_5$ each represent an alkylene group, an arylene group or an aralkylene group, $R_6$ stands for hydrogen or an alkyl group, an aryl group or an aralkyl group; Z stands for a simple bond, oxygen, imino or a divalent organic group; and n, p and q each mean O or a positive integer, with the proviso that n, p and q do not simultaneously mean O.

The 2-equivalent couplers of the present invention which couplers are represented by the general formula (I) have a high dye-forming speed, cause neither fogging nor color-staining in light-sensitive layers and exhibit a good dispersibility into the layers constituting a light-sensitive photographic material, such as a light-sensitive layer so that they can be dispersed into such layers at high concentrations. These advantageous properties are due to the specific structures of the linking group and split-off group at the active position of the couplers in accordance with the invention. In addition, a dye obtained from this coupler has an excellent durability to light, heat and moisture and exhibits such an excellent light-absorption characteristic that it has none of unnecessary absorptions but shows a desirable sharp absorption. Still further, the couplers of the present invention are free of such a development inhibiting property as shown by some conventional 2-equivalent couplers.

Thus, for example, when the 2-equivalent couplers in accordance with the present invention are incorporated into a light-sensitive silver halide photographic material, the thickness of the light-sensitive layer can remarkedly be reduced, and a high resolving power and a high sharpness can be attained in the dye image. Still further, in case of a multi-layered light-sensitive photographic material, the permeability of light into lower layers can be improved with the result that the photographic sensitivity is improved.

In the above-mentioned general formula (I), $R_1$ and $R_2$ each stand for hydrogen, halogen such as a chlorine, bromine or iodine atom or a monovalent group. As the monovalent group, there can be mentioned for example nitro, hydroxy, cyano, carboxy, an amino group, sulfo, an alkyl group (such as methyl, ethyl, propyl, or octyl), an alkenyl group (such as allyl or octenyl), an aryl group (such as phenyl or naphthyl), a heterocyclic ring (such as pyridinyl, quinonyl, thienyl, piperidyl, imidazolyl, morpholino, furyl, thiazolyl, oxazolyl, benzthiazolyl, benzoxazolyl, benzimidazolyl or furanyl), an alkoxy group (such as methoxy or ethoxy), an aryloxy group (such as phenoxy), an arylthio group (such as phenylthio), an arylazo group, an acylamino group (such as acetylamino or benzoylamino), a carbamoyl group, an ester group, an acyl group (such as acetyl), an acyloxy group (such as acetyloxy), a sulfonamido group, a sulfamoyl group and a sulfonyl group. These groups and ring include the substituted of which substituent or substituents are appropriately selected from such as halogen, nitro, cyano, an amino group, hydroxy, carboxy, sulfo, an alkyl group, an ester group, an aryl group, an alkoxy group, an aryloxy group, an arylazo group, an acylamino group, a carbamoyl group or an acyl group, and these groups also include the substituted of which substituent or substituents are an adequate group or groups described for $R_1$ and $R_2$.

$R_3$, $R_4$ and $R_5$ each stand for an alkylene group (such as methylene, ethylene, trimethylene or propylene), an arylene group (such as phenylene or naphthylene) or a divalent group containing at least one alkylene group and at least one arylene group linked thereto (such as benzylidene or xylylene). These groups include the substituted of which substituent or substituents are those as in the groups described above for $R_1$ and $R_2$.

$R_6$ stands for hydrogen, an alkyl group (such as methyl, ethyl or isopropyl), an aralkyl group (such as tolyl) or an aryl group (such as phenyl or naphthyl). These groups also include the substituted of which substituent or substituents are appropriately selected from any of the groups described for $R_1$ and $R_2$ or a group of the following general formula (V):

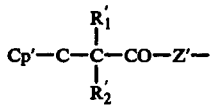

(V)

wherein Cp' stands for a monovalent residue obtained by eliminating one hydrogen atom at the active position of a yellow, magenta or cyan coupler; $R_1'$, $R_2'$ and Z' are as defined for $R_1$, $R_2$ and Z in the general formula (I), respectively; and Cp and Cp' may be either the same or different.

Z stands for a simple bond, oxygen, an imino group (such as imino, methylimino, ethylimino, or hydroxyethylimino), an alkylene group (such as methylene, ethylene, trimethylene or propylene), an aralkylene group (such as tolylene or xylylene) or an arylene group (such as phenylene or naphthylene). These groups include the substituted having the same substituents as in the groups described for $R_1$ and $R_2$.

n, p and q stand for O or a positive integer, with the proviso that n, p and q do not simultaneously mean O.

In particular, useful are the compounds of the general formula (I) wherein $R_1$ and $R_2$ each stand for hydrogen, halogen, nitro, hydroxy, cyano, carboxy, an amino group, sulfo, an alkyl group having 1 to 4 carbon atoms, an alkenyl group having 2 to 4 carbon atoms, a phenyl group, an alkoxy group having 1 to 4 carbon atoms, a phenyloxy group or a phenylthio group, $R_3$, $R_4$ and $R_5$ each stand for an alkylene group having 1 to 4 carbon atoms, a phenylene group or a divalent group in which at least one alkylene group having 1 to 4 carbon atoms and at least one phenylene group are linked to each other, $R_6$ stands for hydrogen, an alkyl group having 1 to 32 carbon atoms or a phenyl group, Z stands for a simple bond, oxygen, imino, an alkylene group having 1 to 4 carbon atoms or a phenylene group, and n, p and q each stand for 0 or an integer of 1 to 10, wherein said groups for $R_1$, $R_2$, $R_3$, $R_4$, $R_5$ and Z include the substituted of which substituent or substituents are such as halogen, nitro, cyano, an amino group, hydroxy, carboxy, sulfo, an alkyl group having 1 to 4 carbon atoms, an ester group, a phenyl group, an alkoxy group having 1 to 4 carbon atoms, a phenyloxy group, an acylamino group having 1 to 6 carbon atoms or an acyl group having 1 to 6 carbon atoms, all of which include the substituted having any of those described for said groups, and wherein said $R_6$ include those containing a substituent or substituents selected from any of the groups described for $R_1$–$R_5$ and Z or a group of the general formula (V) illustrated above.

In the above-described general formula (I), Cp is a coupler residue removed a split-off group from a coupler. The coupler residue may be derived not only from a coupler having only one active position in the molecule, but also from a so-called polyfunctional coupler, that is to say, a coupler having two or more active positions in the molecule. When the coupler residue consists of a radical resulting from elimination of one hydrogen atom from one of the active positions of a polyfunctional coupler, the hydrogen at other active position(s) may be not substituted, or may be substituted by any of the active position-substituents in accordance with the invention or other active position-substituents. As the coupler residue, a phenol cyan coupler residue, an α-naphthol cyan coupler residue and pyrazoloquinazolone cyan coupler residue are cited for example. More specifically, as cyan coupler residues are in particular useful those of the general formula (II), (III) or (IV):

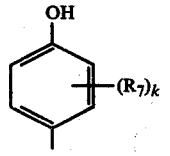

(II)

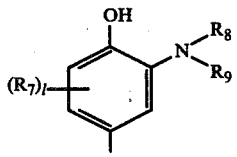

(III)

-continued

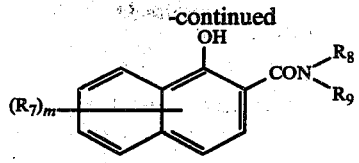

(IV)

In each of the above-illustrated formulas, $R_7$, $R_8$ and $R_9$ each stand for any atom or group which is used in conventional 4-equivalent phenol or α-naphthol couplers. As more specific examples of $R_7$, there can be mentioned hydrogen, halogen, an aliphatic hydrocarbon group, an acylamino group or a group of the formula —O—$R_{10}$ or —S—$R_{10}$ wherein $R_{10}$ stands for an aliphatic hydrocarbon group. When two or more $R_7$'s are present in the same molecule, they may be different from each other. When $R_7$ stands for an aliphatic hydrocarbon group, the group includes a substituted residue. $R_8$ and $R_9$ each may stand for a group selected from the group consisting of an aliphatic hydrocarbon group, an aryl group and a heterocyclic ring. These groups and ring include the substituted, and one of $R_8$ and $R_9$ may stand for hydrogen. Alternatively, $R_8$ and $R_9$ may cooperatively form an N-containing heterocyclic ring together with the nitrogen atom to which they are attached. k stands for an integer of from 1 to 4, l for an integer of from 1 to 3 and m for an integer of from 1 to 5. The above-mentioned aliphatic hydrocarbon group may be either saturated or unsaturated, and may be straight-chained, branched or cyclic. As preferred examples, there can be mentioned an alkyl group having 1–32 carbon atoms (such as methyl, ethyl, propyl, isopropyl, butyl, t-butyl, isobutyl, n-octyl, t-octyl, dodecyl, octadecyl, eicosyl), a 5–7 membered ring cycloalkyl group (such as cyclopentyl, cyclohexyl or cycloheptyl), and an alkenyl group having 2–18 carbon atoms (such as allyl, butenyl or octenyl). As representative examples of the above-mentioned aryl group, there can be mentioned a phenyl group, a naphthyl group and an anthranyl group. As representative examples of the above-mentioned heterocyclic ring, there can be mentioned a 5- or 6-membered heterocyclic ring containing nitrogen, oxygen and/or sulfur (such as pyridinyl, pyrimidyl, quinolyl, thienyl, piperidyl, thionyl, oxazolyl, triazolyl and imidazolyl). Those groups and ring include those having a substituent or substituents all of which are selected from halogen and nitro, hydroxyl, carboxyl, an amino group, sulfo, an alkyl group, an alkenyl group, an aryl group, a heterocyclic ring, an alkoxy group, an aryloxy group, an arylthio group, an arylazo group, an acylamino group, a carbamoyl group, an ester group, an acyl group, an acyloxy group, a sulfonamido group, a sulfamoyl group and a sulfonyl group.

More specific useful cyan coupler residues are disclosed for example in U.S. Pat. Nos. 2,423,730, 2,474,293, 2,801,171, 2,895,826, 3,476,563, 3,737,316, 3,758,308 and 3,839,044, British Pat. Nos. 1,446,728 and 112,038 and Japanese Laid-Open-To-Public Patent Publication No. 37,425/1972.

Typical examples of split-off groups in the 2-equivalent couplers in accordance with the present invention are listed in the following:

$-OCH_2COOCH_2CH_2OCH_3$ $-OCH_2COOCH_2CH_2OC_2H_5$

-continued $-OCH_2COOCH_2CH_2OC_3H_7(n)$ $-OCH_2COOCH_2CH_2OC_3H_7(iso)$ $-OCH_2COO(CH_2CH_2O)_2CH_3$ $-OCH_2COO(\overset{CH_3}{\overset{|}{C}}HCH_2O)_2CH_3$

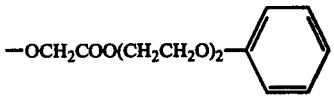

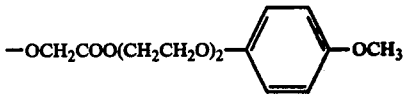

$-OCH_2COO(CH_2CH_2O)_3CH_3$ $-OCH_2COO(CH_2)_3O(CH_2)_2OCH_3$

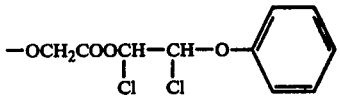

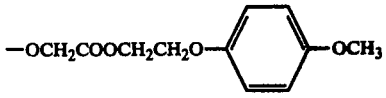

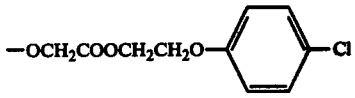

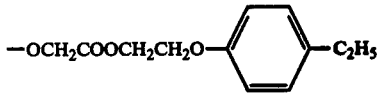

$-OCH_2COOCH_2CH_2OH$ $-OCH_2COO\overset{OH}{\overset{|}{C}}HCH_2OH$ $-OCH\underset{CH_3}{\underset{|}{C}}OOCH_2CH_2OH$ $-OCH\underset{Cl}{\underset{|}{C}}OOCH_2CH_2OH$

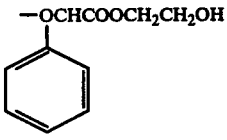

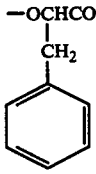

$-OCH\underset{OH}{\underset{|}{C}}OOCH_2CH_2OCH_3$ $-OCH_2COO(CH_2CH_2O)_2H$ $-OCH_2COO(CH_2CH_2O)_3H$ -continued $-OCH\underset{CH_3}{\underset{|}{C}}OOCH_2CH_2OCH_3$

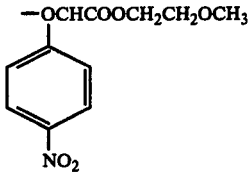

$-O\overset{CH_3}{\overset{|}{\underset{CH_3}{\underset{|}{C}}}}COOCH_2CH_2OCH_3$ $-OCH_2CONHCH_2CH_2OCH_3$ $-OCH_2CONHCH_2CH_2OC_2H_5$ $-OCH_2CONHCH_2CH_2OC_3H_7(n)$ $-OCH_2CONHCH_2CH_2OC_3H_7(iso)$ $-OCH_2CONH(CH_2CH_2O)_2CH_3$ $-OCH_2CONH(CH_2CH_2O)_3CH_3$ $-OCH_2CONH(CH_2)_3O(CH_2)_2OCH_3$ $-OCH_2CONHCH_2CH_2OH$ $-OCH_2CONH(CH_2)_3OH$ $-OCH_2CONH(CH_2CH_2O)_2H$ $-OCH_2CONHCH_2\underset{OH}{\underset{|}{C}}H_2CH_3$ $-OCH_2CON\begin{matrix}CH_2CH_2OH\\CH_2CH_2OH\end{matrix}$

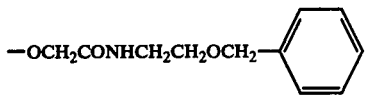

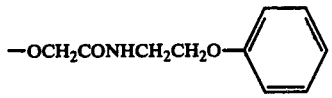

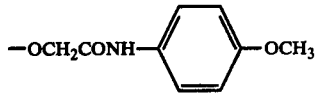

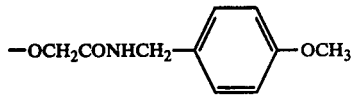

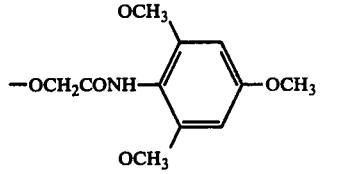

$-OCH\underset{CH_3}{\underset{|}{C}}ONHCH_2CH_2OH$

-continued

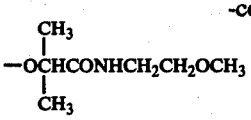

$-OCH_2COCH_2CH_2OCH_3$ $-OCH_2CO(CH_2CH_2O)_2CH_3$

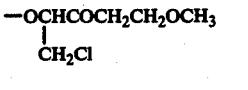

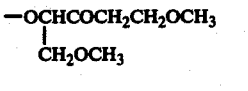

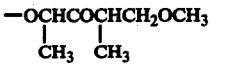

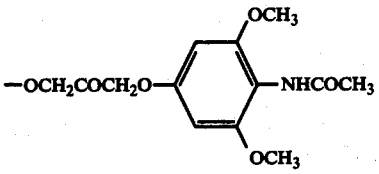

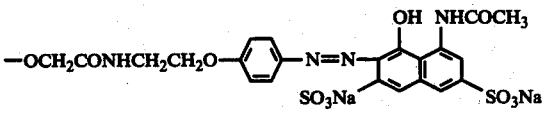

$-OCH_2CONHCH_2CH_2OCH_2CH_2NHCOCH_2O-$ $-OCH_2CONH(CH_2CH_2O)_2C_{12}H_{25}(n)$ $-OCH_2CO\,.\,O(CH_2CH_2O)_6C_2H_5$

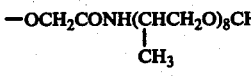

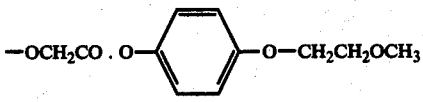

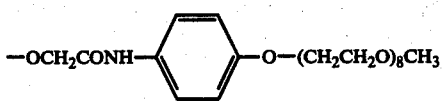

Typical examples of the compounds which can be used in the present invention are illustrated in the following, although the compounds usable in the present invention are by no means limited to these compounds.

Exemplified couplers:

(1) 1-Hydroxy-4-(β-methoxyethoxycarbonylmethoxy)-N-[δ-(2,4-di-tert.-amyl-phenoxy)butyl)-2-naphthamide (2) 1-Hydroxy-4-[β-(β-methoxyethoxy)ethoxycarbonylmethoxy]-N-[δ-(2,4-di-tert.-amyl-phenoxy)-butyl]-2-naphthamide (3) 1-Hydroxy-4-[β-(p-methoxyphenoxy)ethoxycarbonylmethoxy]-N-[δ-(2,4-di-tert.-amyl-phenoxy)-butyl]-2-naphthamide (4) 1-Hydroxy-4-(β-hydroxyethoxycarbonylmethoxy)-N-dodecyl-2-naphthamide (5) 1-Hydroxy-4-[α-(β-methoxyethoxycarbonyl)ethoxy]-N-[δ-(2,4-di-tert.-amyl-phenoxy)butyl]-2-naphthamide (6) 1-Hydroxy-4-(β-methoxyethylaminocarbonylmethoxy)-N-dodecyl-2-naphthamide (7) 1-Hydroxy-4-(β-methoxyethylaminocarbonylmethoxy)-N-[δ-(2,4-di-tert.-amylphenoxy)butyl]-2-naphthamide (8) 1-Hydroxy-4-(β-hydroxyethylaminocarbonylmethoxy)-N-[δ-(2,4-di-tert.-amylphenoxy)butyl]-2-naphthamide (9) 1-Hydroxy-4-(γ-hydroxypropylaminocarbonylmethoxy)-N-[δ-(2,4-di-tert.-amylphenoxy)butyl]-2-naphthamide

(10) 1-Hydroxy-4-(γ-hydroxypropylaminocarbonylmethoxy)-N-dodecyl-2-naphthamide

(11) 1-Hydroxy-4-{β-[β-(β-ethoxy)ethoxy]ethoxyethylaminocarbonylmethoxy}-N-[δ-(m-dodecyloxyphenoxy)butyl]-2-naphthamide

(12) 1-Hydroxy-4-(β-isopropyloxyethylaminocarbonylmethoxy)-N-(o-tetradecyloxyphenyl)-2-naphthamide

(13) 1-Hydroxy-4-(di-β-hydroxyethyl-aminocarbonylmethoxy)-N-(o-tetradecyloxyphenyl)-2-naphthamide

(14) 1-Hydroxy-[β-(p-methoxybenzyloxy)ethylaminocarbonylmethoxy]-N-[β-(β-carboxyheneicosanoyl)aminoethyl]-2-naphthamide

(15) 1-Hydroxy-[β-(p-methylphenoxy)ethylaminocarbonylmethoxy]-N-[δ-(2,4-di-tert.-amylphenoxy)-butyl]-2-naphthamide

(16) 1-Hydroxy-4-(p-methoxyanilinocarbonylmethoxy)-N-octadecyl-N-(3,5-di-carboxyphenyl)-2-naphthamide

(17) 1-Hydroxy-4-(2,4,6-trimethoxyanilinocarbonylmethoxy)-N-[δ-(2,4-di-tert.-amylphenoxy)butyl]-2-naphthamide

(18) 1-Hydroxy-4-[α-(β-methoxyethylaminocarbonyl-)ethoxy]-N-[β-(β-carboxyheneicosanoyl)aminoethyl]-2-naphthamide

(19) 1-Hydroxy-4-(β-chloro-α-(β-methoxyethylcarbonyl)ethoxy]-N-dodecyl-2-naphthamide

(20) 1-Hydroxy-4-(4-acetamino-3,5-di-methoxyphenoxymethylcarbonylmethoxy)-N-[δ-(2,4-di-tert.-amylphenoxy)butyl]-2-naphthamide

(21) 1-Hydroxy-4-[β-(β-dodecyloxy)ethoxyethylaminocarbonylmethoxy]-N-ethyl-N-(3,5-di-carboxyphenyl)-2-naphthamide

(22) 1-Hydroxy-4-[β-(β-methoxyethoxy)ethylaminocarbonylmethoxy]-N-cyclohexyl-2-naphthamide

(23) [1-Hydroxy-4-(β-methoxyethylaminocarbonylmethoxy)-2-naphthoyl]morpholine

(24) 1-Hydroxy-4-[β-(1-hydroxy-3,6-di-sulfo-δ-acetylaminonaphthylazophenoxy)ethylaminocarbonylmethoxy]-N-[δ-(2,4-di-tert.-amylphenoxy)-butyl]-2-naphthamide-di-sodium salt

(25) Bis[β-(1-hydroxy-2-N-dodecylcarbamoyl-4-naphthoxyacetyl)-aminoethyl]ether

(26) 2-Chloro-3-methyl-4-(β-methoxyethoxycarbonylmethoxy)-6-[α-(2,4-di-tert.-amylphenoxy)-butyrylamino]phenol

(27) 2-Tetrafluoropropionylamino-4-(β-methoxyethylaminocarbonylmethoxyethylaminocarbonylmethoxy)-5-[α-(2,4-di-tert.-amylphenoxy)-butyrylamino]phenol

(28) N,N'-bis[1-hydroxy-4-(β-ethoxyethylaminocarbonylmethoxy)-2-naphthoyl]dodecylenediamine In the couplers of the present invention are included of course those couplers which are the same as the above-exemplified couplers except in that the split-off groups are replaced by other split-off groups described above.

In general, the couplers in accordance with the present invention can be readily prepared by various methods, for example, from active position-substituted couplers consisting of the couplers with one hydrogen atom at the active position substituted by a hydroxyl group, or from intermediate products thereof. More specifically, in the case of cyan couplers of the naphthol type, a naphthol type cyan coupler having a hydroxyl group in the 4-position of the 1-naphthol nucleus (for example, 1,4-dihydroxy-2-naphthanilide, 2,4-di-tert.-amylphenoxybutyl-1,4-dihydroxy-2-naphthamide, or 1,4-dihydroxy-2-tetradecyloxyphenyl-2-naphthamide) is reacted, in any suitable sovlent (such as an alcohol, acetone, dimethylformamide or dimethylsulfoxide) in the presence of a base, with the corresponding halide (such as α-bromoacetyl-β'-methoxyethylamine, or α-chloroacetyl-γ'-hydroxypropylamine) to give the corresponding 4-position-carbonylmethoxy-substituted coupler. As base for the reaction is preferably used an inorganic base such as sodium hydroxide, potassium hydroxide, sodium carbonate or potassium carbonate.

The naphthol type cyan couplers can also be prepared from intermediate products of the above-described 1,4-dihydroxynaphthol type couplers. Thus, for example, such an intermediate product (for example, 1,4-dihydroxy-2-naphthoic acid phenyl, methyl or ethyl ester) is reacted, in the same manner as described above, with the corresponding reaction partner, for example, α-bromoacetyl-β'-methoxyethylamine, to form the corresponding β-methoxyethylaminocarbonylmethoxy derivative, which derivative in turn is directly melted together with a suitable amine (for example, aniline, 2,4-di-tert.-amylphenoxybutylamine, or 2-tetradecyloxyaniline) by heating. It is also possible to hydrolyze, in a conventional manner, the ester part of the intermediate product to form the corresponding free carboxylic acid, which is, either after converted in a conventional manner into the corresponding acid chloride or in the presence of dicyclohexylcarbodiimide, reacted with the corresponding amine. Other couplers can be prepared in the same way.

The phenol type couplers of the present invention can be prepared for example by protecting one of the hydroxyl groups of a 1,4-dihydroxybenzene derivative with a benzyl group, reacting the protected derivative with the corresponding reactant, for example, α-bromoacetyl-β'-methoxyethylamine in the same manner as in the case of the naphthol type couplers, and hydrogenating the reaction product in the conventional manner.

Typical instances of the synthesis of the couplers in accordance with the present invention will now be described in the following.

Synthetic Example 1

Synthesis of Exemplified Coupler 1

0.02 mole of 1,4-dihydroxy-2-naphthoic acid is dissolved in 60 ml of dimethylformamide (DMF) and to the solution is added dropwise a 40% aqueous solution of sodium hydroxide (0.04 mole) under a nitrogen gas stream at a room temperature. After the addition has been completed, 0.02 mole of β'-methoxyethyl-α-bromoacetate dissolved in 10 ml of DMF is added dropwise at a room temperature to the mixture. After the dropwise addition, the resulting mixture is stirred for 3 to 4 hours at a room temperature to effect reaction. After completion of the reaction, the reaction mixture is poured into 200 ml of ice water containing 2 ml of hydrochloric acid, whereupon crystals precipitate out. The crystals are filtered off, washed well with water, air-dried overnight and recrystallized from acetonitrile to obtain a product (intermediate product) as crystals, pale yellow to pale yellowish green in color, which have a melting point of 180° to 181° C. (decomp.).

To 0.02 mole of the thus obtained intermediate product is added first 120 ml of dioxane and then 0.02 mole of 2,4-di-tert.-amylphenoxybutylamine. To the resulting mixture is added dropwise, with stirring at a room temperature, 0.02 mole of dicyclohexylcarbodiimide dissolved in 30 ml of dioxane. After completion of the dropwise addition the resulting mixture is stirred at a temperature of 40° to 50° C. for 30 minutes and then cooled down to a room temperature, whereupon the urea product precipitates out. The urea product is filtered off and the filtrate is concentrated. The residue is recrystallized from an ethylalcohol to obtain the desired product which has a melting point of 125.0° to 126.0° C.

Synthetic Example 2

Synthesis of Exemplified Coupler 6

0.02 mole of 1,4-dihydroxy-2-naphthoic acid is dissolved in 60 ml of DMF and to the solution is added dropwise a 40% aqueous solution of sodium hydroxide (0.04 mole) under a nitrogen gas stream at a room temperature. After completion of the dropwise addition, 0.02 mole of α-bromoacetyl-β'-methoxyethylamine dissolved in 10 ml of DMF is added dropwise at a room temperature to the mixture. After completion of the dropwise addition, the resulting reaction mixture is stirred for 4 to 5 hours at a temperature of 40° to 50° C. to effect reaction. After completion of the reaction, the reaction mixture is poured into 200 ml of ice water containing 2 ml of hydrochloric acid, whereupon crystals precipitate out. The crystals are filtered off, washed well with water, air-dried overnight and recrystallized from acetonitrile to obtain a product (intermediate product) as crystals, green in color, which have a melting point of 181° to 182° C. (decomp.).

To 0.02 mole of the thus obtained intermediate product is added first 120 ml of dioxane and then 0.02 mole of n-dodecylamine. To the resulting mixture is added dropwise, with stirring at a room temperature, 0.02 mole of dicyclohexylcarbodiimide dissolved in 30 ml of dioxane. After completion of the dropwise addition the reaction mixture is stirred at a temperature of 50° to 60° C. for 30 minutes and then cooled down to a room temperature, whereupon the urea product precipitates out. The urea product is filtered off and the filtrate is concentrated. The residue is recrystallized from an ethylalcohol to obtain the desired product which has a melting point of 100.5° to 101.5° C.

Synthetic Example 3

Synthesis of Exemplified Coupler 7

To 0.02 mole of the intermediate product obtained in Synthetic Example 2 is added first 120 ml of dioxane and then 0.02 mole of 2,4-di-tert.-amylphenoxybutylamine. To the resulting mixture is added dropwise, with stirring at a room temperature, 0.02 mole of dicyclohexylcarbodiimide dissolved in 30 ml of dioxane. After completion of the dropwise addition the reaction mixture is stirred at a temperature of 40° to 50° C. for 30 minutes and then cooled down to a room temperature, whereupon the urea product precipitates out. The urea product is filtered off and the filtrate is concentrated. The residue is recrystallized from an ethylalcohol to obtain the desired product which has a melting point of 130.0° to 131.0° C.

Synthetic Example 4

Synthesis of Exemplified Coupler 8

0.02 mole of 1,4-dihydroxy-2-naphthoic acid is dissolved in 60 ml of DMF and to the solution is added dropwise a 40% aqueous solution of sodium hydroxide (0.04 mole) under a nitrogen gas stream at a room temperature. After completion of the dropwise addition 0.02 mole of α-chloroacetylethanolamine dissolved in 10 ml of DMF is added dropwise at a room temperature to the mixture. After completion of the dropwise addition, the resulting reaction mixture is stirred at a room temperature for 3 to 4 hours to effect reaction. After completion of the reaction, the reaction mixture is poured into 200 ml of ice water containing 2 ml of hydrochloric acid, whereupon crystals precipitate out. The crystals are filtered off, washed well with water, air-dried overnight and recrystallized from acetonitrile to obtain a product (intermediate product), pale brown in color, which as a melting point of 184° to 185° C. (decomp.).

To 0.02 mole of the thus obtained intermediate product is added first 120 ml of dioxane and then 0.02 mole of 2,4-di-tert.-amylphenoxybutylamine. To the resulting mixture is added dropwise, with stirring at a room temperature, 0.02 mole of dicyclohexylcarbodiimide dissolved in 30 ml of dioxane. After completion of the dropwise addition the reaction mixture is stirred at a temperature of 40° to 50° C. for 30 minutes and then cooled down to a room temperature, whereupon the urea product precipitates out. The urea product is filtered off and the filtrate is concentrated. The residue is recrystallized from an ethylalcohol to obtain the desired product which has a melting point of 142.5° to 143.5° C.

Synthetic Example 5

Synthesis of Exemplified Coupler 9

0.02 mole of 1,4-dihydroxy-2-naphthoic acid is dissolved in 60 ml of DMF and to the solution is added dropwise a 40% aqueous solution of sodium hydroxide (0.04 mole) under a nitrogen gas stream at a room temperature. After completion of the dropwise addition 0.02 mole of α-chloroacetyl-γ-hydroxyethylamine dissolved in DMF is added dropwise at a room temperature to the mixture. After completion of the dropwise addition, the resulting reaction mixture is stirred at a temperature of 40° to 50° C. for 6 to 7 hours to effect reaction. After completion of the reaction, the reaction mixture is poured into 200 ml of ice water containing 2 ml of hydrochloric acid, whereupon crystals precipitate out. The crystals are filtered off, washed well with water, air-dried overnight and recrystallized from acetonitrile to obtain a product (intermediate product), pale brown in color, which has a melting point of 185° to 186° C. (decomp.)

To 0.02 mole of the thus obtained intermediate product is added first 120 ml of dioxane and then 0.02 mole of 2,4-di-tert.-amylphenoxybutylamine. To the resulting mixture is added dropwise, with stirring at a room temperature, 0.02 mole of dicyclohexylcarbodiimide dissolved in 30 ml of dioxane. After completion of the dropwise addition the reaction mixture is stirred at a temperature of 50° to 60° C. for 30 minutes and then cooled down to a room temperature, whereupon the urea product precipitates out. The urea product is filtered off and the filtrate is concentrated. The residue is recrystallized from a mixture of petroleum ether and an ethylalcohol to obtain the desired product which has a melting point of 142.5° to 143.5° C.

Synthetic Example 6

Synthesis of Exemplified Coupler 10

To 0.02 mole of the intermediate product obtained in the Synthetic Example 5 is added first 120 ml of dioxane and then 0.02 mole of dodecylamine. To the resulting mixture is added dropwise, with stirring at a room temperature, 0.02 mole of dicyclohexylcarbodiimide dissolved in 30 ml of dioxane. After completion of the dropwise addition the reaction mixture is stirred at a temperature of 50° to 60° C. for 30 minutes and then cooled down to a room temperature, whereupon the urea product precipitates out. The urea product is filtered off and the filtrate is concentrated. The residue is recrystallized from a mixture of petroleum ether and an ethylalcohol to obtain the desired product which has a melting point of 127.0° to 128.0° C.

Synthetic Example 7

Synthesis of Exemplified Coupler 26

0.02 mole of 4-benzyloxy-3-chloro-2-methyl-5-[α-(2,4-di-tert.-amylphenoxy)-butyrylamino]phenol is dissolved in 200 ml of acetone. To the solution is added first 0.05 mole of potassium carbonate and then 0.02 mole of α-chloroacetyl-β-methoxyethylamine, and the resulting mixture is heated under reflux for 48 hours. After cooling, the reaction mixture is freed from insolubles by filtration, and the filtrate is concentrated. The residue is dissolved in a mixture of 150 ml of methanol and 150 ml of tetrahydrofuran and the solution is charged with 1.0 g of 4% palladium-carbon (Pd/C) to effect hydrogenation. After the calculated volume of hydrogen (450 ml) has been absorbed, the reaction mixture is freed of insolubles (the Pd/C) by filtration and the filtrate is concentrated. The residue is recrystallized from a mixture of n-hexane and benzene to obtain the desired product which has a melting point of 158.5° to 160.0° C.

Other couplers can also be readily prepared in the same manner as described in the above-described Synthetic Examples.

The results of the elementary analysis of the couplers synthesized above or in the same manner as described above are listed in the following Table A.

Table A

| Exemplified Coupler Nos. | | Elementary Analysis Values C | H | N | Cl | F | S |
|---|---|---|---|---|---|---|---|
| (1) | Calculated | 71.14 | 8.13 | 2.30 | | | |
| | Found | 70.99 | 8.08 | 2.34 | | | |
| (2) | Calculated | 70.01 | 8.19 | 2.15 | | | |
| | Found | 69.91 | 8.20 | 2.19 | | | |
| (3) | Calculated | 72.07 | 7.63 | 2.00 | | | |
| | Found | 72.11 | 7.65 | 2.15 | | | |
| (4) | Calculated | 68.47 | 8.30 | 2.95 | | | |
| | Found | 68.53 | 8.26 | 2.95 | | | |
| (5) | Calculated | 71.46 | 8.26 | 2.25 | | | |
| | Found | 71.32 | 8.15 | 2.26 | | | |
| (6) | Calculated | 69.10 | 8.70 | 5.76 | | | |
| | Found | 68.92 | 8.69 | 5.66 | | | |
| (7) | Calculated | 71.25 | 8.31 | 4.62 | | | |
| | Found | 71.27 | 8.27 | 4.53 | | | |
| (8) | Calculated | 70.91 | 8.16 | 4.72 | | | |
| | Found | 70.75 | 8.14 | 4.79 | | | |
| (9) | Calculated | 71.25 | 8.30 | 4.61 | | | |
| | Found | 71.12 | 8.47 | 4.79 | | | |
| (10) | Calculated | 69.10 | 8.70 | 5.75 | | | |
| | Found | 69.00 | 8.73 | 5.72 | | | |
| (11) | Calculated | 68.58 | 8.56 | 3.72 | | | |
| | Found | 68.62 | 8.59 | 3.62 | | | |

Table A-continued

| Exemplified Coupler Nos. | | Elementary Analysis Values C | H | N | Cl | F | S |
|---|---|---|---|---|---|---|---|
| 12 | Calculated | 71.94 | 8.58 | 4.41 | | | |
| | Found | 72.10 | 8.46 | 4.50 | | | |
| (13) | Calculated | 69.78 | 8.23 | 4.40 | | | |
| | Found | 69.75 | 8.27 | 4.36 | | | |
| (14) | Calculated | 68.83 | 8.48 | 5.12 | | | |
| | Found | 68.77 | 8.52 | 5.26 | | | |
| (15) | Calculated | 73.86 | 7.97 | 4.10 | | | |
| | Found | 74.00 | 7.81 | 4.15 | | | |
| (16) | Calculated | 70.56 | 7.46 | 3.57 | | | |
| | Found | 70.44 | 7.51 | 3.69 | | | |
| (17) | Calculated | 70.56 | 7.61 | 3.92 | | | |
| | Found | 70.71 | 7.86 | 3.79 | | | |
| (18) | Calculated | 67.64 | 9.00 | 5.77 | | | |
| | Found | 67.81 | 8.95 | 5.59 | | | |
| (19) | Calculated | 66.96 | 8.14 | 2.69 | 6.81 | | |
| | Found | 67.04 | 8.23 | 2.44 | 6.84 | | |
| (20) | Calculated | 69.81 | 7.45 | 3.70 | | | |
| | Found | 70.03 | 7.35 | 3.56 | | | |
| (21) | Calculated | 66.07 | 7.39 | 3.95 | | | |
| | Found | 66.11 | 7.46 | 3.89 | | | |
| (22) | Calculated | 64.99 | 7.04 | 6.31 | | | |
| | Found | 65.04 | 7.16 | 6.28 | | | |
| (23) | Calculated | 61.84 | 6.22 | 7.21 | | | |
| | Found | 61.69 | 6.31 | 7.30 | | | |
| (24) | Calculated | 57.85 | 5.40 | 6.36 | | | 5.82 |
| | Found | 57.62 | 5.29 | 6.51 | | | 5.74 |
| (25) | Calculated | 69.94 | 8.48 | 6.04 | | | |
| | Found | 69.73 | 8.46 | 6.03 | | | |
| (26) | Calculated | 65.00 | 8.01 | 4.73 | 5.99 | | |
| | Found | 65.05 | 7.96 | 4.70 | 5.96 | | |
| (27) | Calculated | 59.54 | 6.90 | 6.12 | | 11.08 | |
| | Found | 59.66 | 6.95 | 6.03 | | 10.83 | |

The thus obtainable couplers in accordance with the present invention exhibit a much higher dye-forming speed at the color development step not only than conventional 4-equivalent cyan couplers, but also than 2-equivalent couplers containing as the split-off group an aryloxy group such as a phenoxy or nitrophenoxy group or an ester-linked group such as an acetoxy or benzoyloxy group as well as such 2-equivalent couplers as disclosed in Japanese Laid-Open-To-Public Patent Publication No. 117,442/1975. Furthermore, as compared with conventional couplers of analogous structure, the couplers of the invention are more readily dispersible in protective colloids for photographic use such as gelatin. The oil-soluble couplers of the present invention have an excellent solubility in coupler solvents. On the other hand, the couplers of the present invention having hydrophilic groups show an excellent adaptability to Fisher dispersions. So-called "outer type" couplers of the present invention which are to be used outside light-sensitive photographic materials can be very easily added to color developers or the like. These favorable properties further lead to the advantages that when the couplers of the present invention are incorporated in light-sensitive layers of light-sensitive photographic materials as so-called "inner type" couplers, the thickness of the light-sensitive layer can be remarkably reduced and that the sharpness and other characteristics of the resulting color image can be highly improved. In addition to these advantages, the couplers in accordance with the present invention have no adverse influences on the color development and show in particular good reactivity, with the result that they do not cause color stain or other defects. Moreover, the dyes obtained by using the couplers of the present invention have excellent absorption characteristics as pointed out hereinbefore.

The coupler of the present invention can be applied in various manners by selecting appropriately the combination of the basic structure and the split-off group. Thus, for example, when the coupler residue has a water-solubilizing group such as a sulfo or carboxyl group to impart diffusibility to the coupler, or when the split-off group bearing the carbonylmethoxy linking group in accordance with the present invention per se is diffusible, the coupler can be used as a diffusible coupler, for example, for the so-called outer type photography, wherein it is to be incorporated into a color developer. As a good example of this type, there can be mentioned Coupler (22) exemplified above.

Furthermore, the coupler of the present invention having a diffusible coupler residue in combination with a split-off group which is not diffusible, for example due to its bearing a diffusion-resistant group such as a long-chain aliphatic hydrocarbon residue, can also be used in the outer type photography in the same manner as in the case of the coupler of the type described above, if the non-diffusiblity of the split-off group is moderate and the entire structure of the coupler consisting of the split-off group linked to the coupler residue at the active position of the latter exhibits diffusibility.

In addition to the above-mentioned Coupler (22), there can be preferably used, for example, Exemplified Couplers (21) and (23) as the outer type coupler.

According to the outer type photography, as is well known in the art, a coupler is incorporated into a color developer and a light-sensitive coupler-free photographic material, in particular a black-and-white light-sensitive silver halide photographic material (designed for the outer type photography) is used. When the light-sensitive materials is exposed imagewise to light and then processed in the above-described color developer, the color-developing agent and diffusible coupler penetrate into the light-sensitive material and the color-developing agent is brought into reaction with the diffusible coupler in the presence of a silver halide having a development nucleus, whereby a dye, thus finally a dye image, is formed. When it is desired to form a multi-colored image, a color development processing is usually applied in which color development is carried out by processing successively with different color developers containing different couplers (for example, a cyan coupler, a magenta coupler and a yellow coupler).

The color developer of the type described above may contain, in addition to the color-developing agent and the coupler, a variety of photographic processing additives customarily used as components of color developers, such as alkali metal sulfites, carbonates, bisulfites, bromides and iodides. A typical formulation of such developer is as follows:

| Formulation of Color Developer | |
|---|---|
| Color developing agent | 1 to 5 g |
| Anhydrous sodium sulfite | 1 to 3 g |
| Anhydrous sodium carbonate | 10 to 60 g |
| Potassium bromide | 0.5 to 1.5 g |
| Coupler | 1 to 3 g |
| Water to make | 1 liter |

In outer type color developers containing the couplers in accordance with the present invention, a higher solubility in color developers is exhibited in comparison with that of conventional couplers, especially when such outer type couplers as mentioned above as suitable examples for use in the outer type photography are used.

Among the couplers in accordance with the present invention, a coupler which has a diffusible coupler residue and a diffusible split-off group but which is non-diffusible as a whole, a coupler which has a non-diffusible coupler residue and a diffusible split-off group and which is non-diffusible as a whole, and a coupler which has a non-diffusible coupler residue and a diffusible split-off group and which is diffusible as a whole are all suitable for use in diffusion transfer photography. In order to render these groups diffusible, it is possible to adopt techniques of selecting low molecular weight groups and/or introducing water-solubilizing groups such as mentioned above, for example, a sulfo group. On the other hand, in order to render these groups non-diffusible, it is possible to adopt techniques of introducing a long-chain aliphatic hydrocarbon residue and/or selecting a relatively high molecular weight group.

Even a coupler having both a diffusible coupler residue and a diffusible split-off group can be used for the diffusion transfer photography if the chemical portion which is not necessary for formation of an image is non-diffusible at the time of color development. Thus, for example, if a hydroquinone residue, a resorcinol residue or the like is introduced into one of the coupler residue and split-off group either directly or through a suitable linking group, the resulting coupler can be effectively used for the diffusion transfer photography. When such diffusion transfer photography is adopted, an image is formed either by a method in which a developed dye formed by the reaction between the coupler residue and the color-developing agent is utilized for the image formation or by a method in which the split-off group eliminated in the course of color development is utilized for the image formation. In the former method it is necessary that the developed dye should be diffusible and in the latter method it is necessary that a compound formed by elimination of the split-off group from the active position should be diffusible. In the case where the elimination product is utilized, it is also necessary that the product should assume a color. Thus, for example, the product contains a dye portion, for example, an azo dye portion, in the molecule. Preferred split-off groups of this type are for example those of the following general formula (IX):

$$-O-\underset{R_2}{\overset{R_1}{C}}-COZ(R_3O)_n(R_4O)_p(R_5O)_q \cdot D \qquad \text{(IX)}$$

wherein $R_1$, $R_2$, $R_3$, $R_4$, $R_5$ and Z have the same meanings as described for the general formula (I) and n, p and q each stand for the same meaning as in the general formula (I), and D stands for a dye residue.

In the above-described general formula (IX), the dye residue D preferably contains a water-solubilizing group. Preferred examples of such dye residue include monovalent residues of azo dyes, azomethine dyes, indoaniline dyes, indophenol dyes and anthraquinone dyes.

As an example of coupler suitable for use in diffusion transfer photography can be mentioned Exemplified Coupler (21).

In the diffusion transfer photographic process, as is well known in the art, a light-sensitive material and an image-receiving material are used in combination. According to this photographic technique, the light-sensitive material, after exposed to light, is superposed on the image-receiving material at least in the development step, whereby a transfer image is formed on the image-receiving material. Thus, for example, a coupler-containing light-sensitive silver halide material and an image-receiving material with the image-receiving layer provided on a support through a sub layer, an inter layer and the like are used in combination, and after the light-sensitive silver halide material has been exposed to light, the light-sensitive layer of the light-sensitive silver halide material is superposed on the image-receiving material optionally through a protective layer. After that, development is effected by causing a color developer to penetrate between the two layers, whereupon a dye formed in the light-sensitive layer is diffused and transferred onto the image-receiving layer. Finally, the image-receiving layer is separated from the light-sensitive material, whereby a color image is formed on the thus separated image-receiving material. A variety of methods of practicing this diffusion transfer photographic process are known. Thus, for example, a light-sensitive material is integrated with an image-receiving material, whereby the steps of superposing the light-sensitive material on the image-receiving material and peeling the image-receiving material from the light-sensitive material can be omitted. In this type of method, if a boundary layer between the image-receiving material and the light-sensitive material, or a layer adjacent thereto, is an opaque layer, a support of the light-sensitive material should be transparent and the light-sensitive material is exposed to light through this transparent support. If the boundary layer or the layer adjacent thereto is substantially transparent, at least one of these layers should be opacified in a step after exposure to light so that the finally obtained image may not be adversely affected by the image in the light-sensitive material. Such opacification is conducted, for example at the time of color development. In this type of light-sensitive material/image-receiving material combination unit, the support of the image-receiving material or that of the light-sensitive material (at least the former support) must be transparent, and exposure to light is conducted through the transparent support. After the exposure to light, a color developer is caused to penetrate into the interface between the light-sensitive material and the image-receiving material or in the vicinity of this interface, whereby an image is formed in the image-receiving layer.

According to another type of diffusion transfer photographic method, a color developer is previously included in an image-receiving material, whereby the development and image transfer can be accomplished simply by superposing an exposed light-sensitive material on the image-receiving material.

The couplers in accordance with the present invention can be effectively used for any type of diffusion transfer photography. In general, the coupler of the present invention is included in a light-sensitive layer. In this case, a light-sensitive silver halide material is preferred as the light-sensitive layer. In general, the coupler is incorporated in an amount of about 0.07 mole to about 0.7 mole, preferably 0.1 to 0.4 mole, per mole silver halide.

Couplers of the type known as so-called inner type couplers are used in such a way that they are previously incorporated in light-sensitive materials, especially light-sensitive silver halide materials. Preferably, a non-diffusible coupler is used so as to prevent other layers from being adversely affected by the coupler. Among the above-mentioned couplers to be used for the diffusion transfer process, those which are non-diffusible can be effectively used as such inner type coupler. Couplers having a non-diffusible coupler residue are especially preferred. In such couplers, the split-off group may be either diffusible or non-diffusible.

As preferred examples of couplers of the type described above can be mentioned Exemplified Couplers (1), (6), (7) and (9).

Some of these inner type couplers are substantially colorless, and are couplers of the usual type in which a dye is formed through reaction of the couplers with an oxidation product of a color developing agent formed during the color development. There are also inner type couplers which assume colors. Such couplers are called colored couplers and they can be used for color compensation according to the masking method. As a preferred example of a coupler suitable for use for the purpose of such color compensation can be mentioned Exemplified Coupler (24). In color compensation according to the masking method, the color of the colored coupler disappears, or the colored coupler is removed from the system of the light-sensitive material, in the course of color development processing, and simultaneously therewith, a developed dye is formed as a result of reaction with the color-developing agent. In this type of color compensation, the color of colored coupler itself is utilized for color compensation. In general, such colored coupler is used in combination with a substantially colorless coupler.

These inner type couplers can be divided into two groups: one containing a hydrophilic group in the molecule and the other containing an oleophilic group in the molecule. Thus, for example, when these couplers are to be incorporated into coating compositions for formation of light-sensitive layers, the former group of couplers, namely so-called Fisher dispersion type couplers, are incorporated as a solution or a dispersion in an alkaline solution, whereas the latter group of couplers, namely so-called protect type couplers, are incorporated as a solution in a coupler solvent. As a typical example of coupler of the former type can be mentioned Exemplified Coupler (18). When an appropriate means of dispersing is employed according to the type of coupler, the couplers of the present invention exhibit a much better solubility than conventional couplers, with the result that they provide dye images of higher density. In addition to the advantage, they provide further advantages, for example, that the transparency of layers can be highly improved and that the resolving power can be remarkably enhanced.

In general, in incorporating the couplers of the present invention into light-sensitive silver halide layers, the coupler is used in an amount of about 0.07 mole to about 0.7 mole, preferably 0.1 to 0.4 mole, per mole silver halide. When the coupler is used for the purpose of color adjustment or for improving the characteristics of other couplers used in combination therewith, it is used in general in an amount of about 0.01 mole to about 0.1 mole, preferably about 0.03 to about 0.07 mole, per mole silver halide.

As illustrated hereinbefore, the couplers in accordance with the present invention find a variety of use in compliance with various objects of application and exhibit excellent properties in every use.

As light-sensitive materials to which the couplers in accordance with the present invention can be applied are preferred light-sensitive silver halide materials. The couplers of the present invention can be used with light-sensitive silver halide materials of a variety of types, for example, light-sensitive silver halide materials especially intended for application to diffusion transfer processes as mentioned above, negative light-sensitive materials for general use, reversal light-sensitive materials for general use, positive light-sensitive materials for general use, direct positive light-sensitive materials and light-sensitive silver halide materials for special use as in printing, X-ray photography, high resolving power photography, infrared photography and ultraviolet photography.

As silver halides to be used for these different types of light-sensitive silver halide materials, there can be mentioned, for example, silver bromide, silver iodide, silver iodobromide, silver chlorobromide and silver chloroiodobromide. These silver halides can be prepared by a variety of methods, for example, the neutral method, the ammonia method, the simultaneous mixing method, the conversion method and the like. When it is intended to use a mixed silver halide, the mixing ratio of two or more silver halides is appropriately chosen. Thus, for example, in the case of a silver halide having a relatively low sensitivity and a relatively fine particle size, silver chloride is used as the predominant component, whereas in the case of a silver halide having a relatively high sensitivity, the content of silver chloride is reduced. The silver halides which can be used in direct positive light-sensitive materials include, for example, those of the Herschel reversal type and of the solarization type. In general, these silver halides are appropriately sensitized, either optically or chemically, to impart a suitable fog to silver halide grains. More specifically, these silver halides can be chemically sensitized, for example, with active gelatin, sulfur sensitizers (such as allylthiocarbamide, thiourea and cystine), selenium sensitizers, reducing sensitizers (such as stannous salts and polyamines), or noble metal sensitizers, for example, gold sensitizers (such as potassium aurithiocyanate, potassium chloroaurate and 2-aurosulfo benzothiazole methochloride) or water-soluble salts of ruthenium, rhodium, iridium or the like (such as ammonium chloropalladate, potassium chloroplatinate and sodium chloropalladite). Some of the last-mentioned water-soluble salts are required to be used in sensitizing amounts, since they act as either sensitizer or fog inhibitor in dependence on the amount used. The above-mentioned sensitizers may be employed either alone or in appropriate combination (for example a combination of a gold sensitizer and a sulfur sensitizer or a combination of a gold sensitizer and a selenium sensitizer).

The silver halides can also be optically sensitized to any desired wavelength region. Thus, for example, they can optically sensitized by the use of zeromethine dyes, monomethine dyes, dimethine dyes, trimethine dyes or the like cyanine or merocyanine dyes. These optical sensitizers may be employed either alone or, especially for the purpose of super-sensitization, in combination.

A light-sensitive layer is formed by dispersing the silver halide into a suitable protective colloid. In general, gelatin is used for formation of a light-sensitive layer and other constitutional layers such as an interlayer, a protective layer, a filter layer, an image-receiving layer, a pH-adjusting layer (to be used, for example, as a layer to be disposed below the image-receiving layer) and the like. In addition, colloidal albumin, cellulose derivatives and synthetic resins such as polyvinyl compounds (for example, polyvinyl alcohol) can be used as well. These materials can be employed either alone or in combination. Still further, acetyl cellulose having an acetyl content of 19 to 26% and a water-soluble ethanolamine cellulose acetate may be used in combination with the foregoing protective colloids.

As support materials for the light-sensitive materials, there can be employed films and sheets of such substrates as paper, laminated paper (for example, a laminate of polyethylene and paper), glass, cellulose acetate, cellulose nitrate, polyester (for example, polyethylene terephthalate), polycarbonate, polyamide, polystyrene and polyolefin. These support materials can be subjected to various surface treatments such as hydrophilizing treatments, for example, for the purpose of improving their adhesion to other constitutional layers. Among these surface treatments are included, for example, saponification, corona discharge, subbing and setting treatments.

The light-sensitive materials comprise at least a support and a light-sensitive layer formed thereon. In general, however, they may have a multi-layered structure including other suitable layers disposed in appropriate positions in accordance with the particular purposes of provision such as those mentioned above.

The cyan coupler in accordance with the present invention may be used in any appropriate combination, among them and/or with other 2-equivalent and/or 4-equivalent couplers. In the case of inner type light-sensitive materials, couplers which, upon development, produce dyes having different hues are incorporated into their respective light-sensitive layers sensitized to appropriate wavelength regions. In the case of pseudo-color light-sensitive materials and the like, the couplers in accordance with the present invention may be used singly or in combination, it also being possible to use them in combination with other couplers. In this case, the relation between the wavelength region to which the light-sensitive material is sensitized and the hue of the dye formed from the coupler is not necessary in agreement with that in ordinary color light-sensitive materials.

Furthermore, in color light-sensitive materials, the light-sensitive layer sensitized to a certain wavelength region may comprise two or more layers. These light-sensitive layers may be different with respect to the sensitivity, and different types of couplers, for example, a 2-equivalent coupler and a 4-equivalent coupler, which form dyes having the same color, may be incorporated separately into these layers. This technique is generally adopted for the purpose of further improving the resolving power and the sensitivity.

As mentioned above, the couplers in accordance with the present invention may be used in combination with other 2-equivalent or 4-equivalent couplers. As 2-equivalent couplers usable in combination with the couplers of the present invention, there can be mentioned, for example, so-called colored couplers (for example, those couplers having a split-off group linked thereto at the active position through the azo group included in the split-off group as the linking group) or so-called DIR couplers (for example, couplers of the type in which a development inhibitor is released upon color development, such as those having at the active position a split-off group bearing a thio group as the linking group).

A variety of photographic additives may be incorporated for different purposes into the light-sensitive layers and/or other constitutional layers such as inter layers, sub layers, filter layers, protective layers and image-receiving layers. As such photographic additives, there can be mentioned, for example, stabilizers (such as mercury compounds, triazoles, azaindenes, zinc salts and cadmium salts), sensitizers (such as quaternary ammonium salts and polyethylene glycols), film property-improvers (such as glycerin, dihydroxyalkanes, ethylenebisglycolic acid esters and polymer emulsions and dispersions), hardeners (such as formaldehyde, halogen-substituted fatty acids, disulfonic chlorides, bis-aziridines, vinylsulfones and ethylene imines), spreaders (such as saponin, polyethylene glycol lauryl or oleyl monoether and sulfated and alkylated polyethylene glycol salts), organic solvents such as coupler solvents, i.e. high-boiling solvents and/or low-boiling solvents, (for example, dibutyl phthalate, tricresyl phosphate, acetone, methanol, ethanol, and ethyl cellosolve), so-called DIR compounds which, upon color development, are capable of releasing a color development inhibitor and forming a substantially colorless compound, antistatic agents, antifoamers, ultraviolet absorbers, fluorescent whitening agents, anti-slip agents, matting agents, anti-halation agents, anti-irradiation agents, oxidation inhibitors and staining inhibitors. These different photographic additives may be used singly or in combination.

An image-receiving layer which is formed separately from a light-sensitive material such as those mentioned above and is used for the diffusion transfer process in combination with the light-sensitive material comprises at least a support such as those mentioned above and an image-receiving layer formed on the support. If necessary or desired, it may contain other layers such as protective layers, sub layers and pH-adjusting layers. In addition, as layer-constituting component for these respective constitutional layers may be used protective colloids such as those mentioned above, in which colloids can be incorporated various photographic additives such as those mentioned above for different purposes. Thus, for example, in order to prevent re-diffusion or irradiation of the diffusible dye diffused from the light-sensitive layer in the course of color development, it is preferred that a compound capable of trapping the dye or rendering the dye non-diffusible be incorporated into the image-receiving layer. Such a compound may be incorporated into a layer adjacent to the image-receiving layer. As representatives of the compounds used for these purposes, there can be mentioned, for example, mordants (for example, polymers of aminoguanidine derivatives of vinyl methyl ketone such as those disclosed in U.S. Pat. No. 2,882,156, and such mordants as disclosed in U.S. Pat. Nos. 3,271,148 and 3,271,147), and pH-adjusting agents such as inorganic or organic acids.

A color developer which is used for color development of the exposed light-sensitive material comprises a color developing agent as the main ingredient. Typical color developing agents which are used in accordance with the present invention are aromatic primary amines such as p-phenylenediamines and p-aminophenols, especially the former. More specific examples of these amines include diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-methanesulfonamidoethyl-4-aminoaniline, 4-N-ethyl-N-β-hydroxyethylaminoaniline, N-ethyl-N-β-methoxyethyl-3-methyl-4-aminoaniline p-toluenesulfonate, N-ethyl-N-[2-(2-methoxyethoxy)ethyl]-3-methyl-4-aminoaniline p-toluenesulfonate, N-ethyl-N-{2-[2-(2-methoxyethoxy)ethoxy]ethyl}-3-methyl-4-aminoaniline p-toluenesulfonate, N-ethyl-N-{2-[2-(2-(2-(2-methoxyethoxy)ethoxy)ethoxy)ethoxy]ethyl}-3-methyl-4-aminoaniline p-toluenesulfonate, o-aminophenol, p-aminophenol, 5-amino-2-oxy-toluene, 2-amino-3-oxy-toluene and 2-oxy-3-amino-1,4-dimethyl-benzene.

These color developing agents may be used singly or in combination, or they may be used, if desired, in combination with a black-and-white developing agent such as hydroquinone. The color developer generally contains an alkaline agent such as sodium hydroxide, ammonium hydroxide, sodium carbonate, sodium sulfate and sodium sulfite, and it may further contain different additives, for example, an alkali metal halide such as potassium bromide or an alkali metal thiocyanate, a development adjusting agent such as citrazinc acid or benzyl alcohol, a thickening agent and a water-softening agent. In a certain type of diffusion transfer process, the color developer is incorporated in advance into the image-receiving material. In this case, it is possible to adopt a technique in which the color developing agent is separated from the alkaline agent, in other words, either the alkaline agent or the color developing agent is incorporated into the image-receiving material, which is processed, upon color development, with a color developer containing the other. The pH value of the color developer is generally not lower than 7, and most generally in the range of from about 10 to about 13.

The couplers of the present invention form dyes by reaction with an oxidation product of the color developing agent produced when the silver halide is developed with a color developer of the type described above, and some of them form other dyes.

In the light-sensitive silver halide color photographic materials in which the couplers of the present invention are used, a dye image can be effectively formed with the use of a color developer containing both a color developing agent of the aromatic primary amine type and an oxidizing agent which is to be subjected to a redox reaction under the effect of the metallic silver image.

When a color developer of the type described above is used, the color developing agent is oxidized with the oxidizing agent and the resulting oxidation product is then coupled with a photographic coupler to form a dye image. Oxidizing agents suitable for this purpose are cobalt complexed having a coordination number of 6. The color photographic processing with such color developers is especially effective when applied to so-called silver-saving light-sensitive color photographic materials having a lower silver content than ordinary light-sensitive silver halide color photographic materials.

As in particular useful cobalt complexes can be mentioned, for example, those which contain ligands selected from the group consisting of ethylenediamine, diethylenetriamine, triethylenetetramine, amine, nitrate, nitrile, azide, chloride, thiocyanate, isothiocyanate, water and carbonate, and especially those which contain (1) at least two ethylenediamine ligands, (2) at least five amine ligands or (3) at least one triethylenetetramine ligand. As in particular preferred examples can be mentioned cobalt complexes of the following general formulas: $[Co(En)_2(N_3)_2]X$; $[Co(En)_2Cl(NCS)]X$; $(Co(En)_2(NH_3)N_3]X$; $[Co(En)_2Cl_2]X$; $[Co(En)_2(SCN)_2]X$; $[Co(En)_2(NCS)_2]X$; and $[Co(NH_3)_6]X$.

In the above-described formulas, En stands for ethylenediamine and X stands for an anion selected from at least one member of the group consisting of chloride, bromide, nitrite, nitrate, perchlorate, acetate, carbonate, sulfite, sulfate, hydrochloride, thiocyanate, iso thiocyanate and hydroxide. Most preferred complexes are hexamminecobalt salts, for example, chloride, bromide, sulfite, sulfate, perchlorate, nitrite and acetate. These cobalt complexes used in color developers generally in concentrations of about 0.1 g to about 50 g, preferably about 1 g to about 15 g per liter color developer.

The light-sensitive silver halide color photographic materials employing the couplers in accordance with the present invention can be successfully applied to a color photographic process which comprises developing an exposed light-sensitive silver halide color photographic material in a color developer containing a color developing agent of the aromatic primary amine, and bringing the thus developed material into contact with an amplifier containing an oxidizing agent of the type as mentioned above, for example, a cobalt complex having a coordination number of 6, in the presence of the color developing agent which has been received by the light-sensitive layer in the course of the color development processing and transferred into the amplifying bath. It is preferred in this case to process the light-sensitive silver halide color photographic materials with an amplifier which contains, in addition to an oxidizing agent, a silver halide development-inhibiting agent. In this way, it becomes possible to practice the amplification processing under ordinary roomlight conditions. According to such procedure, it is possible to observe the course of dye formation and to stop the processing after the desired dye density has been reached. As preferred development-inhibiting agents, there can be mentioned, for example, water-soluble bromides such as potassium bromide, as well as heterocyclic compounds, such as tetrazoles, azaindenes and triazoles, which do not contain mercapto groups or ionic iodide.

The concentration of the cobalt complex used in the amplifier is in general in the range of from about 0.2 g to about 20 g/l, preferably from about 1 g to about 15 g/l. When a water-soluble bromide is used as the development-inhibiting agent, it is incorporated in the amplifier generally in a concentration in the range of from about 1 g to about 40 g/l. On the other hand, when a compound of a heterocyclic structure is used as the development-inhibiting agent, it is incorporated generally in a concentration in the range of from about 0.01 g to about 3 g/l. The amplifying bath is used in general at a pH value of from 6 to 14, preferably from 8 to 12.

For the purpose of removing, after color development, the silver halide or developed silver in the light-sensitive material out of the system, a combination of a bleacher and a fixer or a bleach-fixer is generally used. These bleaching and fixing processings are combined with other processings, for example, water-washing, stopping and stabilizing processings. As preferred components for such fixer can be mentioned, for example, silver halide solvents such as sodium thiosulfate and ammonium thiosulfate. As preferred components for such bleacher can be mentioned, for example, red prussiates and ethylenediaminetetraacetic acid iron (II), ammonium or sodium salts.

The present invention will now be described in more detail by the following examples which by no means limit the scope of the invention.

EXAMPLE 1

The couplers indicated in Table 1 were used. 10 g of each of the couplers was added to a liquid mixture of 10 ml of dibutyl phthalate and 20 ml of ethyl acetate, and the resulting mixture was warmed up to 60° C. to dissolve the coupler completely. The thus obtained solution was mixed with 5 ml of a 10% aqueous solution of Alkanol B (alkylnaphthalene sulfonate manufactured by E. I. du Pont de Nemours and Company) and 200 ml of a 5% aqueous solution of gelatin, and the mixture was emulsified with the help of a colloid mill to provide a coupler dispersion.

The thus obtained dispersion was then added to 500 g of a high speed negative silver iodobromide emulsion with a silver iodide content of 60 mole%, and the mixture was coated on a cellulose triacetate film base and dried.

The thus prepared specimen was subjected to light exposure through an optical wedge and then developed at 20° C. for 10 minutes with a color developer having the following formulation:

| | |
|---|---|
| N-Ethyl-N-β-methanesulfonamidoethyl-3-methyl-4-aminoaniline sulfate | 5.0 g |
| Anhydrous sodium sulfite | 2.0 g |
| Sodium carbonate (monohydrate) | 50.0 g |
| Potassium bromide | 1.0 g |
| Sodium hydroxide | 0.55 g |
| Benzyl alcohol | 4.0 ml |
| Water to make 1 liter | |

The specimen was then subjected to the conventional stopping and fixing processings, washed with water for 10 minutes and bleached at 20° C. for 5 minutes with a bleacher having the following formulation:

| | |
|---|---|
| Red prussiate | 100 g |
| Potassium bromide | 50 g |
| Water to make 1 liter | |

The thus processed specimen was then washed with water for 5 minutes and then fixed at 20° C. for 5 minutes with a fixer having the following formulation:

| | |
|---|---|
| Sodium thiosulfate (pentahydrate) | 250 g |
| Water to make 1 liter | |

The specimen was then washed again with water for 25 minutes and dried.

The photographic characteristics of the thus processed specimens were measured to obtain the results shown in Table 1.

Table 1

| Specimen No. | Coupler used | Relative speed | Gamma(γ) | Maximum density ($D_{max}$) | Maximum absorption wavelength (λmax; nm) | Image Light fastness % | Image Moisture fastness % |
|---|---|---|---|---|---|---|---|
| 1 | Exemplified Coupler (1) | 155 | 1.40 | 2.41 | 695 | 96 | 99 |
| 2 | Exemplified Coupler (7) | 170 | 1.50 | 2.54 | 695 | 96 | 98 |
| 3 | Exemplified Coupler (10) | 145 | 1.73 | 2.87 | 695 | 95 | 98 |
| 4 | Comparative Coupler (1) | 100 | 1.07 | 2.10 | 695 | 94 | 96 |
| 5 | Comparative Coupler (2) | 125 | 1.35 | 2.47 | 695 | 94 | 97 |

In Table 1, the relative speed is expressed with respect to the speed, taken as 100, of the specimen in which Comparative Coupler (1) was used. The structure of Comparative Coupler (1) is specified below. The light fastness is expressed in terms of the ratio in % of the residual density after 16 hour-exposure of each image to a Xenon Fade Meter to the density before the exposure, which is taken as 100%. The moisture fastness is expressed in terms of the ratio in % of the residual density after 2 week-storage at a relative humidity of 80% and a temperature of 50° C. to the density before the testing, which is taken as 100%.

Comparative Coupler (1): 1-Hydroxy-4-chloro-N-[δ-(2,4-di-tert.-amylphenoxy)butyl]-2-naphthamide (disclosed in the specification of U.S. Pat. No. 2,474,293).

Comparative Coupler (2): 1-Hydroxy-4-(ethoxycarbonylmethoxy)-N-[δ-(2,4-di-tert.-amylphenoxy)butyl]-2-naphthamide (disclosed in Japanese Laid-Open-To-Public Patent Publication No. 117,422/1975).

As can be seen from the results shown in Table 1, the couplers in accordance with the present invention exhibit excellent photographic characteristics (such as high speed, excellent light fastness and excellent moisture fastness), and all the specimens in which the couplers of the present invention were used provide a color image having high sharpness.

When the same procedure was followed except in that Exemplified Couplers (2), (12) and (15) were used instead of Exemplified Couplers (1), (7) and (10), the couplers were found to have photographic characteristics as inner type coupler as excellent as mentioned above.

EXAMPLE 2

10 g of Exemplified Coupler (6) was added to a mixture of 10 ml of dibutyl phthalate and 20 ml of ethyl acetate, and the resulting mixture was warmed up to 60° C. to dissolve the coupler completely. The resulting solution was mixed with 5 ml of a 10% aqueous solution of Alkanol B and 200 ml of a 5% aqueous solution of gelatin, and the mixture was emulsified with the help of a colloid mill to form a coupler dispersion.

The thus obtained dispersion was added to 500 g of a high speed red-sensitive silver iodobromide emulsion (with a silver iodide content of 4.0 mole%), and the mixture was coated on a cellulose acetate film base and dried to obtain a light-sensitive silver halide color photographic material having stable coating.

The thus obtained light-sensitive photographic material was exposed to light in the same manner as in Example 1 and developed at 21° C. for 12 minutes with a developer having the following formulation:

| | |
|---|---|
| Metol | 3.0 g |
| Anhydrous sodium sulfite | 50.0 g |
| Hydroquinone | 6.0 g |

-continued

| | |
|---|---|
| Anhydrous sodium carbonate | 40.0 g |
| Potassium bromide | 3.5 g |
| Potassium thiocyanate | 2.0 g |
| Water to make 1 liter | |

The specimen was subjected to the conventional stopping, hardening and water-washing processings, and then to the second exposure to white light. The specimen was then subjected to the color development at 21° C. for 13 minutes with a color developer having the following formulation:

| | |
|---|---|
| N,N-Diethyl-2-methyl-p-phenylenediamine | 3.0 g |
| Anhydrous sodium sulfite | 4.0 g |
| Sodium carbonate (monohydrate) | 20.0 g |
| Potassium bromide | 2.0 g |
| Water to make 1 liter | |

The thus processed specimen was then subjected to the conventional stopping, water-washing, bleaching and fixing processings, and washed with running water for 20 minutes and dried to obtain a positive cyan dye image which is excellent in transparency and has an absorption maximum at 695 nm.

As can be seen from the foregoing, the couplers of the present invention exhibit excellent photographic properties also when used for reversal type light-sensitive materials.

The same excellent results as mentioned above were obtained when the same procedure was followed except in that Exemplified Coupler (19) was used instead of Exemplified Coupler (6).

EXAMPLE 3

20 g of each of Exemplified Coupler (24) and Comparative Couplers (3) and (4) which will be specified below as dissolved in a mixture of 20 ml of tricresyl phosphate and 40 ml of ethyl acetate. From the resulting solution was prepared an emulsified dispersion of each of the couplers. The coupler dispersion was added to 100 ml of a high speed silver iodobromide emulsion and the mixture was coated on a film base and dried to form a light-sensitive silver halide color photographic material.

The light-sensitive photographic material thus obtained was exposed to light in the conventional manner and developed at 38° C. for 3 minutes and 15 seconds with a color developer having the following combination:

| | |
|---|---|
| N-Ethyl-N-(β-hydroxyethyl)-3-methyl-4-aminoaniline hydrochloride | 5.0 g |
| Anhydrous sodium sulfite | 2.0 g |
| Sodium carbonate | 50.0 g |
| Potassium bromide | 1.0 g |
| Sodium hydroxide | 0.55 g |

-continued

| | |
|---|---|
| Water to make 1 liter | |

The thus developed specimen was then bleached at 38° C. for 6 minutes with a bleacher having the following formulation:

| | |
|---|---|
| Disodium ethylenediaminetetraacetate | 40.0 g |
| Ferric chloride | 30.0 g |
| Sodium carbonate (monohydrate) | 20.0 g |
| Potassium bromide | 30.0 g |
| Water to make 1 liter | |

The thus bleached specimen was subjected to the conventional water-washing, fixing and stabilizing processings. In the case where Exemplified Coupler (24) was used, there were obtained a mask positive image having an absorption maximum around 560 nm and a negative cyan dye image having an absorption image around 700 nm and exhibiting an excellent color formation.

The photographic characteristics of the specimen were measured to obtain the results shown in Table 2.

In Table 2, the relative speed is expressed with respect to the speed of the specimen prepared by using Comparative Coupler (3) which is taken as 100.

Comparative Coupler (3): 1-Hydroxy-N-[δ-(2,4-di-tert.-amylphenoxy)butyl]-4-(2-acetylphenylazo)-2-naphthamide (disclosed in the specification of U.S. Pat. No. 3,034,892).

Comparative Coupler (4): 1-Hydroxy-4-(1-hydroxy-3,6-di-sulfo-8-acetylaminonaphthylazoanilinocarbonylmethoxy)-N-[δ-(2,4-di-tert.-amylphenoxy)butyl]-2-naphthamide disodium salt (of the same type as disclosed in Japanese Laid-Open-To-Public Patent Publication No. 117,422/1975).

Table 2

| Specimen No. | Coupler used | Relative speed | Maximum density ($D_{max}$) | Maximum absorption wavelength (λmax; nm) | Maximum absorption wavelength of mask (λmax; nm) |
|---|---|---|---|---|---|
| 6 | Exemplified Coupler (24) | 158 | 2.4 | 700 | 560 |
| 7 | Comparative Coupler (3) | 100 | 1.8 | 700 | 500 |
| 8 | Comparative Coupler (4) | 118 | 2.2 | 700 | 550 |

In Table 2, the maximum absorption wavelength of the mask is the maximum absorption wavelength of the color of the coupler per se.

In this example, the coupler of the present invention was used as a coupler capable of compensating color in accordance with the so-called masking effect. As can be seen from the results shown in Table 2, the couplers of the present invention were found to show excellent photographic characteristics also in this case, and to be remarkably improved over the conventional couplers with respect to the sensitivity, density and the like, providing an excellent dye image having an improved sharpness.

EXAMPLE 4

Exemplified Coupler (21) was incorporated into a high speed negative silver iodobromide emulsion in accordance with the Fischer dispersion method in a concentration of 9.2 mole per mole silver halide, and the thus obtained emulsion was coated on a cellulose triacetate film base and dried in the conventional manner to provide a specimen.

The thus obtained specimen was exposed to light and then processed at 24° C. for 3 minutes with an alkaline developer having the following formulation:

| | |
|---|---|
| Sodium sulfite | 2.0 g |
| 4-N-Ethyl-N-β-hydroxyethylaminoaniline | 11.0 g |
| Water to make 1 liter | |

During this development processing, the light-sensitive layer of the specimen was kept in intimate contact with an image-receiving layer of an image-receiving material containing, in the image-receiving layer provided on a polyethylene coating paper, dimethyl-β-hydroxyethyl-γ-stearoamido-propylammonium hydrogen phosphate. After the development processing, the image-receiving material was peeled off from the light-sensitive material. A sharp position cyan image with excellent photographic characteristics was formed on the image-receiving material. Thus, it was confirmed that the couplers of the present invention are excellent also as coupler for use in the diffusion transfer color photography.

EXAMPLE 5

Exemplified Coupler (22) was dissolved in methanol and by using this solution, an outer type color developer was prepared which has the following formulation:

| | |
|---|---|
| N,N-Diethyl-2-methyl-p-phenylenediamine | 2.0 g |
| Anhydrous sodium sulfite | 2.0 g |
| Sodium carbonate (monohydrate) | 20.0 g |
| Potassium bromide | 1.0 g |
| Exemplified Coupler (22) | 2.0 g |
| Water to make 1 liter | |

A specimen obtained by coating a high speed silver iodobromide emulsion on a subbed polyethylene terephthalate film was exposed to light and developed at 24° C. for 3 minutes with the outer color developer prepared above.

The thus developed specimen was washed with water for 4 minutes, bleached for 5 minutes, washed with water for 5 minutes, fixed for 5 minutes, washed with water for 30 minutes and dried according to conventional procedures. There was thus obtained a cyan image having an absorption maximum at 700 nm and exhibiting a highly desirable spectral absorption characteristic as well as being excellent in other photographic properties.

Thus, it was confirmed that the couplers in accordance with the present invention are useful also as outer type couplers.

EXAMPLE 6

A high speed multi-layered color negative light-sensitive material was prepared by successively coating the following emulsion layers and intermediate layers on a transparent polyethylene terephthalate film support.

Layer No. 1 (Anti-halation layer):

A gelatin layer containing black colloidal silver (dry layer thickness 1μ)

Layer No. 2 (Intermediate layer):

A gelatin layer containing 2,5-di-tert.-octylhydroquinone (dry layer thickness 1μ)

Layer No. 3 (Red-sensitive emulsion layer):

A red-sensitive silver iodobromide emulsion layer containing, per mole of the silver halide, $6.5 \times 10^{-2}$ mole of exemplified coupler (1) as cyan coupler, $1.7 \times 10^{-2}$ mole of 1-hydroxy-N-[δ-(2,4-di-tert.-amylphenoxy)butyl]-4-(2-ethoxycarbonylphenylazo)-2-naphthamide as colored coupler and $4 \times 10^{-3}$ mole of 2-(1-phenyl-5-tetrazolylthio)-4-(2,4-di-tert.-amylphenoxyacetamido)-1-indanone as development inhibitor-releasing (DIR) substance (silver iodide content 8 mole%; silver coverage 3.5 g/m$^2$; dry layer thickness 6μ)

Layer No. 4 (Intermediate layer):

The same as Layer No. 2.

Layer Nos. 5 and 6 (Green-sensitive emulsion layers):

Layer Nos. 5 and 6 are green-sensitive silver halide emulsion layers containing the couplers of the composition specified below and, more specifically, consist of the first green-sensitive lower speed silver iodobromide emulsion layer (silver iodide content 6 mol%; silver coverage 1 g/m$^2$; dry film thickness 3.5μ) as Layer No. 5 and the second green-sensitive high speed silver iodobromide emulsion layer (silver iodide content 6 mole%; silver coverage 1.2 g/m$^2$; dry layer thickness 2.5μ) as Layer No. 6.

| | Layer No. 5 | Layer No. 6 |
|---|---|---|
| Magenta coupler | $6.5 \times 10^{-2}$ | $1.2 \times 10^{-2}$ |
| Colored coupler | $1.5 \times 10^{-2}$ | $5 \times 10^{-3}$ |
| DIR substance | $1.0 \times 10^{-2}$ | $2 \times 10^{-3}$ |

Remarks: Unit of numerical value is mole. Magenta coupler is 1-(2,4,6-trichlorophenyl)-3-(2,4-di-tert.-amylphenoxyacetylaminobenzamido)-4-(β-methoxyethylaminocarbonylmethoxy)-5-pyrazolone. Colored coupler is 1-(2,4,6-trichlorophenyl)-3-(2-chloro-5-octadecenylsuccinimidoanilino)-4-(4-hydroxyphenylazo)-5-pyrazolone. DIR substance is 2-(1-phenyl-5-tetrazolythio)-4-(2,4-di-tert.-amylphenoxyacetamido)-1-indanone.

Layer No. 7 (Intermediate layer):

The same as Layer No. 2.

Layer No. 8 (Yellow filter layer):

A gelatin layer containing yellow colloidal silver and 2,5-di-tert.-octylhydroquinone (dry layer thickness 1μ)

Layer No. 9 (Blue-sensitive emulsion layer):

A blue-sensitive silver iodobromide emulsion layer containing, per mole of the silver halide, $2.5 \times 10^{-1}$ mole of α-pivalyl-α-(β-methoxyethylaminocarbonylmethoxy)-2-chloro-5-(α(2,4-di-tert.-amylphenoxy)butanamido)acetanilide as yellow coupler (silver iodide content 7 mole%; silver coverage 1.2 g/m$^2$; dry layer thickness 7μ)

Layer No. 10 (protective layer):

A gelatin layer (dry layer thickness 1μ)

For the purpose of comparison with the thus obtained high speed color negative light-sensitive material (A), another high speed color negative light-sensitive material (B) was prepared by following the same procedure as mentioned above but using the following cyan, magenta and yellow couplers instead of the cyan coupler in Layer No. 3, the magenta couplers in Layer Nos. 5 and 6 and the yellow coupler in Layer No. 9.

Cyan coupler: 1-hydroxy-4-chloro-N-[δ-(2,3-di-tert.-amylphenoxy)butyl]-2-naphthamide Magenta coupler: 1-(2,4,6-trichlorophenyl)-3-[3-(2,4-di-tert.-amylphenoxyacetamido)benzamido]-4-acetoxy-5-pyrazolone Yellow coupler: α-Pivaloyl-α-(4-carboxy)phenoxy-2'-chloro-5'-[α-(2,4-di-tert.-amylphenoxy)-butyramido]acetanilide These light-sensitive photographic materials (A) and (B) were exposed to light in the same manner as in Example 1 and subjected to color development in accordance with the processing sequence:

| Processing steps (all at 38° C) | Processing time |
|---|---|
| Color development | 3' 15" |
| Bleaching | 6' 30" |
| Water-washing | 3' 15" |
| Fixing | 6' 30" |
| Water-washing | 3' 15" |
| Stabilization | 1' 30" |

The processing solutions used in these processing steps have the following respective formulations.

| Formulation of color developer | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid trisodium salt (monohydrate) | 2.5 g |
| Water to make 1 liter | |
| Potassium hydroxide to adjust to a pH value of 10.0 | |

| Formulaton of bleacher: | |
|---|---|
| Ammonium ferric ethylenediamine-tetraacetate | 100.0 g |
| Diammonium ethylenediaminetetra-acetate | 10.0 g |
| Ammonium bromide | 150.0 g |
| Glacial acetic acid | 10.0 ml |
| Water to make 1 liter | |
| Aqueous ammonia to adjust to a pH value of | 6.0 |

| Formulaton of Fixer: | |
|---|---|
| Ammonium thiosulfate (as 50% aqueous solution) | 162.0 ml |
| Anhydrous sodium sulfite | 12.4 g |
| Water to make 1 liter | |
| Acetic acid to adjust to a pH value of | 6.5 |

| Formulaton of stabilizer: | |
|---|---|
| Formalin (as 37% aqueous solution) | 5.0 ml |
| KONIDAX (manufactured by Konishiroku Photo Industry Co., Ltd.) | 7.5 ml |
| Water to make 1 liter | |

The density of the dye images thus obtained was measured to reveal that the photographic material (A) is superior to the photographic material (B) with respect to speed, gamma, maximum density and light fastness.

What we claim is:

1. A method of processing an imagewise-exposed light-sensitive silver halide color photographic material by a developer, which method comprises conducting said processing in the presence of an aromatic primary amine developing agent and a coupler represented by the following formula (I):

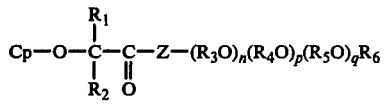

(I)

wherein $C_p$ represents a monovalent residue obtained by removing one hydrogen atom from the active methylene of a phenol or naphthol cyan coupler; $R_1$ and $R_2$ individually represent hydrogen, halogen, nitro, hydroxy, cyano, carboxy, an amino group, sulfo, an alkyl group, an alkenyl group, an aryl group, a pyridinyl group, a quinonyl group, a thienyl group, a piperidyl group, an imidazolyl group, a morpholino group, a furyl group, a thiazolyl group, an oxazolyl group, a benzothiazolyl group, a benzoxazolyl group, a benzimidazolyl group, a furanyl group, an alkoxy group, an aryloxy group, an arylthio group, an acylamino group, an arylazo group, a carbamoyl group, an acyl group, an acyloxy group, a sulfonamido group, a sulfamoyl group or a sulfonyl group; $R_3$, $R_4$ and $R_5$ individually represent an alkylene group, an arylene group or an aralkylene group; $R_6$ represents hydrogen, or an alkyl group, an aryl group or an aralkyl group; Z represents a simple bond, oxygen, imino, alkylene, aralkylene or arylene; and n, p and q individually are zero or an integer of 1 to 10, provided that n, p and q do not simultaneously equal zero.

2. A silver halide color photographic material which comprises a support and a photosensitive layer thereon, the layer comprising silver halide grain and a coupler represented by the following formula (I):

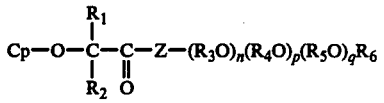

(I)

wherein $C_p$ represents a monovalent residue obtained by removing one hydrogen atom from the active methylene of a phenol or naphthol cyan coupler; $R_1$ and $R_2$ individually represent hydrogen, halogen, nitro, hydroxy, cyano, carboxy, an amino group, sulfo, an alkyl group, an alkenyl group, an aryl group, a pyridinyl group, a quinonyl group, a thienyl group, a piperidyl group, an imidazolyl group, a morpholino group, a furyl group, a thiazolyl group, an oxazolyl group, a benzothiazolyl group, a benzoxazolyl group, a benzimidazolyl group, a fulanyl group, an alkoxy group, a benzimidazolyl group, a furanyl group, an alkoxy group, an aryloxy group, an arylthio group, an acylamino group, an arylazo group, a carbamoyl group, an acyl group, an acyloxy group, a sulfonamido group, a sulfamoyl group or a sulfonyl group; $R_3$, $R_4$ and $R_5$ individually represent an alkylene group, an arylene group or an aralkylene group; $R_6$ represents hydrogen, or an alkyl group, an aryl group or an aralkyl group; Z represents a simple bond, oxygen, imino, alkylene, aralkylene or arylene; and n, p and q individually are zero or an integer of 1 to 10, provided that n, p and q do not simultaneously equal zero.

3. A method according to claim 1 wherein the monovalent residue is represented by the following formula (II), (III) or (IV):

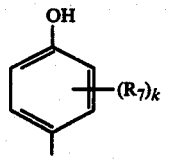
(II)

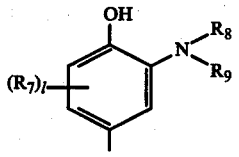
(III)

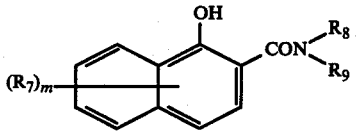
(IV)

wherein $R_7$ represents hydrogen, halogen, —O—$R_{10}$ or —S—$R_{10}$, or an aliphatic hydrocarbon group or an acylamino group; $R_8$ and $R_9$ individually represent a hydrogen, a halogen, an alkyl group, having 1–32 carbon atoms, an alkenyl group having 2–18 carbon atoms, a 5–7 membered cycloalkyl group, an aryl group, a pyridinyl group, a pyrimidyl group, a quinolyl group, a thienyl group, a piperidyl group, an oxazolyl group, a triazolyl group or an imidazolyl group; $R_{10}$ represents an aliphatic hydrocarbon group; k represents an integer of 1 to 4; l is an integer of 1 to 3; and m is an integer of 1 to 5, with the proviso that $R_8$ and $R_9$ do not simultaneously represent hydrogen, also provided that two or more $R_7$'s, if present, may be the same or different from each other, and further provided that $R_8$ and $R_9$ may cooperatively form an N-containing heterocyclic ring with the nitrogen atom to which they are attached, selected from pyridinyl, pyrimidyl, quinolyl, piperidyl, oxazolyl, triazolyl or imidazolyl.

4. A method according to claim 3 wherein $R_8$ and $R_9$ are individually a hydrogen, a halogen, an alkyl group, having 1–32 carbon atoms, an alkenyl group having 2–18 carbon atoms, a 5–7 membered cycloalkyl group, an aryl group, a pyridinyl group, a pyrimidyl group, a quinolyl group, a thienyl group, a piperidyl group, an oxazolyl group, a triazolyl group or an imidazolyl group; or $R_8$ and $R_9$ may co-operatively form a 5- or 6-membered heterocyclic ring together with the nitrogen atom to which they are attached, selected from pyridinyl, pyrimidyl, quinolyl, piperidyl, oxazolyl, triazolyl or imidazolyl.

5. A method according to claim 1 wherein $R_1$ and $R_2$ individually are hydrogen, halogen, nitro, cyano, hydroxy, carboxy, sulfo, or an amino group, an alkyl group (having 1–4 carbon atoms), an alkenyl group (having 2–4 carbon atoms), an alkoxy group (having 1–4 carbon atoms), a phenyl group, a phenoxy group or a phenylthio group.

6. A method according to claim 1 wherein $R_3$, $R_4$ and $R_5$ individually are an alkylene group (having 1–4 carbon atoms) or a phenylene group, or such a divalent group containing at least one alkylene group having 1–4 carbon atoms and at least one phenylene group linked thereto.

7. A method according to claim 1 wherein $R_6$ is hydrogen, or an alkyl group (having 1–32 carbon atoms) or a phenyl group.

8. A method according to claim 1 wherein Z is a simple bond, oxygen, imino, alkylene having 1–4 carbon atoms or phenylene.

9. A method according to claim 3 wherein $R_7$ is hydrogen, halogen, or an alkyl group having 1–32 carbon atoms, an alkenyl group having 2–18 carbon atoms, a cycloalkyl group or an acylamino group, or —O—$R_{10}$ or —S—$R_{10}$ wherein $R_{10}$ is an alkyl group having 1–32 carbon atoms, an alkenyl group having 2–18 carbon atoms or a cycloalkyl group.

10. A silver halide color photographic material according to claim 2 wherein the monovalent residue is represented by the following formula (II), (III) or (IV):

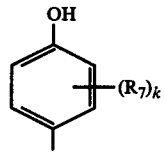
(II)

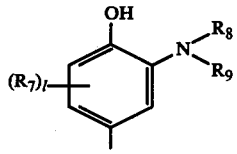
(III)

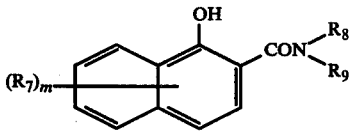
(IV)

wherein $R_7$ represents hydrogen, halogen, —O—$R_{10}$ or —S—$R_{10}$, or an aliphatic hydrocarbon group or an acylamino group; $R_8$ and $R_9$ individually represent hydrogen, or an aliphatic hydrocarbon group, an aryl group or a heterocyclic ring; $R_{10}$ represents an aliphatic hydrocarbon group; k represents an integer of 1 to 4; l is an integer of 1 to 3; and m is an integer of 1 to 5, with the proviso that $R_8$ and $R_9$ do not simultaneously represent hydrogen, also provided that two or more $R_7$'s, if present, may be the same or different from each other, and further provided that $R_8$ and $R_9$ may co-operatively form an N-containing heterocyclic ring with the nitrogen atom to which they are attached.

11. A silver halide color photographic material according to claim 2 wherein $R_1$ and $R_2$ individually are hydrogen, halogen, nitro, cyano, hydroxy, carboxy, sulfo, or an amino group, an alkyl group (having 1–4 carbon atoms), an alkenyl group (having 2–4 carbon atoms), an alkoxy group (having 1–4 carbon atoms), a phenyl group, a phenoxy group or a phenylthio group.

12. A silver halide color photographic material according to claim 2 wherein $R_3$, $R_4$ and $R_5$ are individually an alkylene group (having 1–4 carbon atoms) or a phenylene group, or such a divalent group containing at least one alkylene group having 1–4 carbon atoms and at least one phenylene group linked thereto.

13. A silver halide color photographic material according to claim 2 wherein $R_6$ is hydrogen, or an alkyl group (having 1–32 carbon atoms) or a phenyl group.

14. A silver halide color photographic material according to claim 2 wherein Z is a simple bond, oxygen, imino, alkylene having 1–4 carbon atoms or phenylene.

15. A silver halide color photographic material according to claim 10 wherein $R_7$ is hydrogen, halogen, or an alkyl group having 1–32 carbon atoms, an alkenyl group having 2–18 carbon atoms, a cycloalkyl group or an acylamino group, or —O—$R_{10}$ or —S—$R_{10}$ wherein $R_{10}$ is an alkyl group having 1–32 carbon atoms, an alkenyl group having 2–18 carbon atoms or a cycloalkyl group.

16. A silver halide color photographic material according to claim 10 wherein $R_8$ and $R_9$ are individually a hydrogen, a halogen, an alkyl group, having 1–32 carbon atoms, an alkenyl group having 2–18 carbon atoms, a 5–7 membered cycloalkyl group, an aryl group, a pyridinyl group, a pyrimidyl group, a quinolyl group, a thienyl group, a piperidyl group, an oxazolyl group, a triazolyl group or an imidazolyl group; or $R_8$ and $R_9$ may co-operatively form 5- or 6-membered heterocyclic ring together with the nitrogen atom to which they are attached, selected from pyridinyl, pyrimidyl, piperidyl, oxazolyl, triazolyl or imidazolyl.

* * * * *